US011014772B2

(12) United States Patent
Mori et al.

(10) Patent No.: US 11,014,772 B2
(45) Date of Patent: May 25, 2021

(54) FOLD-ENFORCING ASSEMBLY, POST-PROCESSING APPARATUS, AND IMAGE FORMING SYSTEM

(71) Applicants: Yuuta Mori, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Hisayoshi Sugawara, Kanagawa (JP); Yuusuke Shibasaki, Kanagawa (JP)

(72) Inventors: Yuuta Mori, Kanagawa (JP); Kei Sasaki, Kanagawa (JP); Junya Suzuki, Kanagawa (JP); Koji Furuta, Kanagawa (JP); Yasuo Niikura, Kanagawa (JP); Kazuki Mishina, Kanagawa (JP); Kenji Hari, Kanagawa (JP); Hisayoshi Sugawara, Kanagawa (JP); Yuusuke Shibasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/810,150

(22) Filed: Mar. 5, 2020

(65) Prior Publication Data

US 2020/0307945 A1 Oct. 1, 2020

(30) Foreign Application Priority Data

Mar. 28, 2019 (JP) ..... JP2019-062844

(51) Int. Cl.
*B31F 1/00* (2006.01)
*B65H 45/18* (2006.01)
(Continued)

(52) U.S. Cl.
CPC ..... *B65H 45/18* (2013.01); *B31F 1/00* (2013.01); *B65H 45/04* (2013.01); *B31F 1/0006* (2013.01);
(Continued)

(58) Field of Classification Search
CPC ..... B65H 37/04; B65H 45/04; B65H 45/12; B65H 45/18; B65H 45/30;
(Continued)

(56) References Cited

U.S. PATENT DOCUMENTS 7,562,866 B2 * 7/2009 Hayashi ..... B65H 45/18 270/20.1
8,002,255 B2 * 8/2011 Kawaguchi ..... B65H 45/18 270/45
(Continued)

FOREIGN PATENT DOCUMENTS

EP 1964805 A2 9/2008
EP 2090537 A2 8/2009
(Continued)

OTHER PUBLICATIONS

Extended European Search Report dated Aug. 20, 2020 mailed in corresponding European Appln. No. 20161855.0.

*Primary Examiner* — Leslie A Nicholson, III
(74) *Attorney, Agent, or Firm* — Harness, Dickey & Pierce, P.L.C.

(57) ABSTRACT

A fold-enforcing assembly includes a fold-enforcing device, a moving device to move the fold-enforcing device in a direction of a fold of a sheet bundle, and control circuitry. The fold-enforcing device includes a pressing member pair to nip and press the fold of the sheet bundle in a direction of thickness, a pressing mechanism to pressurize and depressurize the pressing member pair, and a driver to drive the pressing mechanism. Controlled by the control circuitry, the
(Continued)

moving device moves the fold-enforcing device in accordance with a size of the sheet bundle in the direction of the fold; pressing mechanism pressurizes the pressing member pair to press a first end portion of the sheet bundle in the direction of the fold; the moving device moves the fold-enforcing device to a second end portion of the sheet bundle; and pressing mechanism depressurizes the pressing member pair in the second end portion.

17 Claims, 15 Drawing Sheets

(51) Int. Cl.
*B65H 45/04* (2006.01)
*B65H 37/04* (2006.01)
*B65H 45/30* (2006.01)

(52) U.S. Cl.
CPC ..... *B31F 1/0035* (2013.01); *B65H 37/04* (2013.01); *B65H 45/30* (2013.01); *B65H 2301/4505* (2013.01); *B65H 2701/13212* (2013.01); *B65H 2701/1829* (2013.01); *B65H 2801/27* (2013.01)

(58) Field of Classification Search
CPC ..... B65H 2301/51232; B65H 2701/13212; B65H 2801/27; B65H 2701/1829; B65H 2701/18292; B31F 1/00; B31F 1/0006; B31F 1/0035
USPC ..... 270/45, 58.07
See application file for complete search history.

(56) References Cited

U.S. PATENT DOCUMENTS 8,201,815 B2 * 6/2012 Sasahara ..... B65H 45/18 270/45
8,235,371 B2 * 8/2012 Taguchi ..... B31B 50/56 270/45
8,317,180 B2 * 11/2012 Kawaguchi ..... B65H 37/04 270/37
8,459,630 B2 * 6/2013 Watanabe ..... B65H 45/18 270/45
9,643,375 B2 * 5/2017 Oudsen ..... B65H 45/18
9,688,503 B2 * 6/2017 Fukasawa ..... B65H 45/18
9,731,930 B2 * 8/2017 Nobe ..... B65H 45/18
10,710,834 B2 * 7/2020 Hidaka ..... B65H 29/125
2007/0176357 A1 8/2007 Horio et al.
2009/0152792 A1 6/2009 Kato et al.
2011/0198794 A1 8/2011 Kawaguchi
2012/0083400 A1 4/2012 Shibasaki et al.
2012/0086161 A1 4/2012 Nagasako et al.
2012/0153556 A1 6/2012 Sugiyama et al.
2012/0267846 A1 10/2012 Nakada et al.
2012/0282004 A1 11/2012 Furuhashi et al.
2012/0294695 A1 11/2012 Sasaki et al.
2013/0001848 A1 1/2013 Hidaka et al.
2013/0001849 A1 1/2013 Suzuki et al.
2013/0113154 A1 5/2013 Furuhashi et al.
2013/0134659 A1 5/2013 Konno et al.
2013/0147105 A1 6/2013 Sugiyama et al.
2013/0228965 A1 9/2013 Hoshino et al.
2013/0236228 A1 9/2013 Nagasako et al.
2013/0264762 A1 10/2013 Matsushita et al.
2013/0270762 A1 10/2013 Saito et al.
2013/0270763 A1 10/2013 Furuhashi et al.
2013/0300050 A1 11/2013 Suzuki et al.
2014/0011656 A1 1/2014 Niikura et al.
2014/0062003 A1 3/2014 Niitsuma et al.
2014/0062005 A1 3/2014 Suzuki et al.
2014/0062016 A1 3/2014 Watanabe et al.
2014/0138896 A1 5/2014 Yoshida et al.
2014/0145395 A1 5/2014 Takano et al.
2014/0151951 A1 6/2014 Shibasaki et al.
2014/0159301 A1 6/2014 Suzuki et al.
2014/0203501 A1 7/2014 Hoshino et al.
2014/0219747 A1 8/2014 Takahashi et al.
2015/0003938 A1 1/2015 Morinaga et al.
2015/0028540 A1 1/2015 Shibasaki et al.
2015/0030414 A1 1/2015 Takahashi et al.
2015/0045197 A1 2/2015 Sugiyama et al.
2015/0076759 A1 3/2015 Kosuge et al.
2015/0091246 A1 4/2015 Yoshida et al.
2015/0123342 A1 5/2015 Furuhashi et al.
2015/0166280 A1 6/2015 Hino et al.
2015/0225191 A1 8/2015 Niikura et al.
2015/0253716 A1 9/2015 Nagasako et al.
2015/0321872 A1 11/2015 Hari et al.
2015/0353315 A1 12/2015 Suzuki et al.
2015/0360899 A1 12/2015 Takahashi et al.
2016/0016740 A1 1/2016 Niikura et al.
2016/0107853 A1 4/2016 Hashimoto et al.
2016/0107854 A1 4/2016 Hashimoto et al.
2016/0122144 A1 5/2016 Fukumoto et al.
2016/0185552 A1 6/2016 Hoshino et al.
2016/0264370 A1 9/2016 Okutsu et al.
2016/0272443 A1 9/2016 Seto et al.
2016/0340144 A1 11/2016 Sakano et al.
2016/0340145 A1 11/2016 Kunieda et al.
2016/0360053 A1 12/2016 Suzuki et al.
2017/0081140 A1 3/2017 Fukumoto et al.
2017/0174453 A1 6/2017 Akai et al.
2017/0174454 A1 6/2017 Matsuoka et al.
2017/0174458 A1 6/2017 Takano et al.
2017/0174462 A1 6/2017 Edo et al.
2017/0174465 A1 6/2017 Morinaga et al.
2017/0203935 A1 7/2017 Hari et al.
2017/0217239 A1 8/2017 Suzuki et al.
2017/0305706 A1 10/2017 Takahashi et al.
2018/0148286 A1 5/2018 Hari
2018/0251332 A1 9/2018 Hari et al.
2018/0259895 A1 9/2018 Shibasaki et al.
2018/0346265 A1 12/2018 Niikura

FOREIGN PATENT DOCUMENTS

EP 2757061 A1 7/2014
JP 2015-036321 2/2015
JP 2015-218004 A 12/2015

* cited by examiner

FOLD-ENFORCING ASSEMBLY, POST-PROCESSING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2019-062844, filed on Mar. 28, 2019, in the Japan Patent Office, the entire disclosure of which is hereby incorporated by reference herein.

BACKGROUND

Technical Field

The present disclosure relates to a fold-enforcing assembly, a post-processing apparatus, and an image forming system.

Related Art

There are post-processing apparatuses to be used in combination with an image forming apparatus such as a copier. For example, a post-processing apparatus binds one or a plurality of sheets at the center portion of the sheet(s), and folds the sheet bundle at the center portion with a folding roller pair disposed parallel to the sheet folding direction. In this manner, the post-processing apparatus produces a saddle-stitched booklet.

Further, there is a technique of enforcing a fold line of a saddle-stitched booklet with a roller that moves along the spine of the booklet.

SUMMARY

An embodiment of this disclosure provides a fold-enforcing assembly that includes a fold-enforcing device, a moving device to move the fold-enforcing device, and control circuitry. The fold-enforcing device includes a pair of pressing members configured to nip and press a fold of a sheet bundle in a direction of thickness of the sheet bundle, a pressing mechanism configured to pressurize and depressurize the pair of pressing members in the direction of thickness, and a driver configured to drive the pressing mechanism. The moving device moves the fold-enforcing device in a direction of the fold. The control circuitry is configured to move, with the moving device, the fold-enforcing device in accordance with a size of the sheet bundle in the direction of the fold; pressurize, in the direction of thickness, the pair of pressing members to press a first end portion of the sheet bundle in the direction of the fold, with the pressing mechanism; move, with the moving device, the fold-enforcing device to a second end portion of the sheet bundle opposite the first end portion in the direction of the fold; and depressurize, with the pressing mechanism, the pair of pressing members in the second end portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
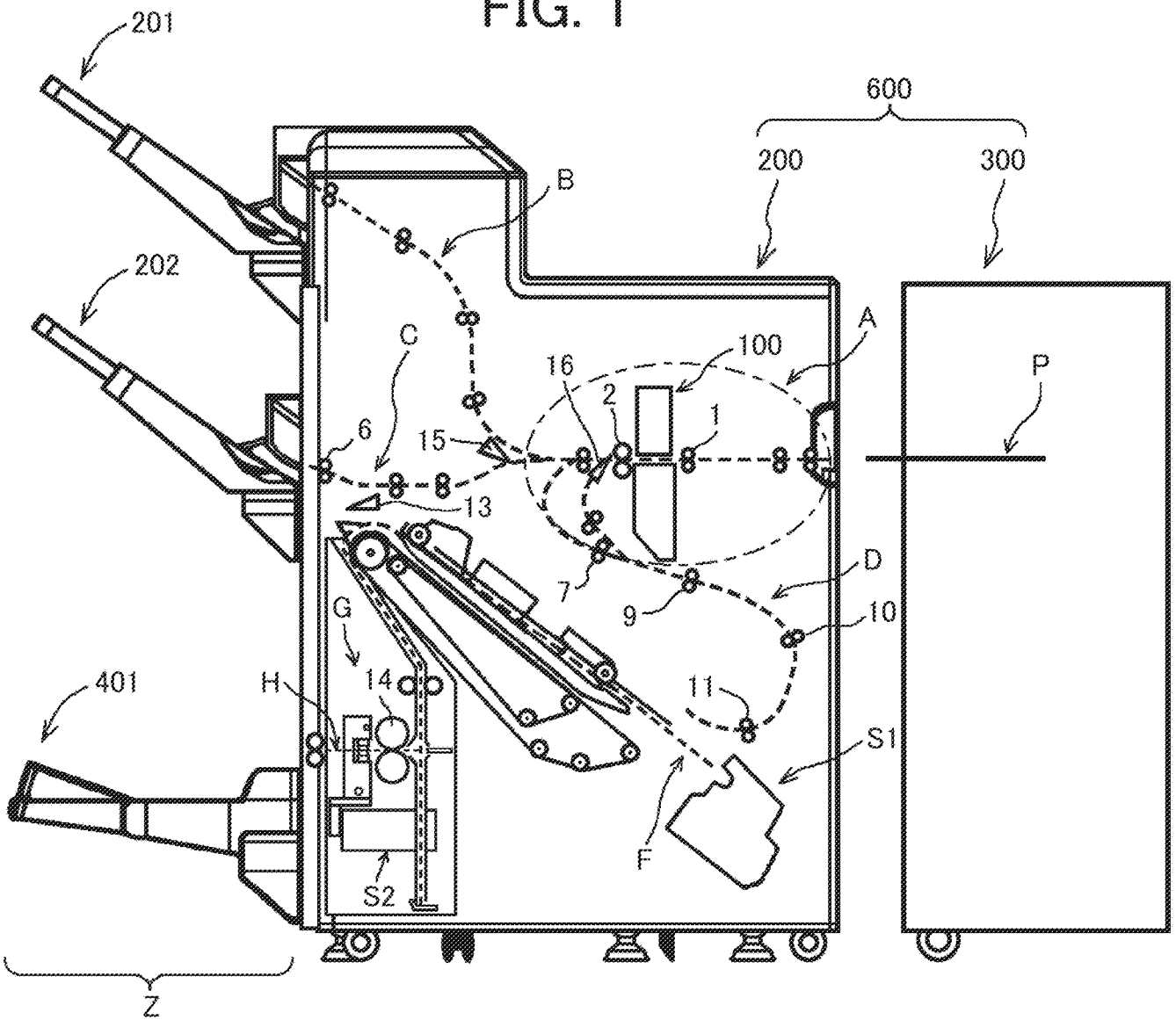
FIG. 1 is a schematic view illustrating a configuration of an image forming system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

FIG. 1 is a diagram schematically illustrating the configuration of an image forming system according to an embodiment of the present disclosure. As illustrated in FIG. 1, an image forming system 600 includes a post-processing apparatus 200 that is a sheet processing apparatus, and an image forming apparatus 300 that supplies the post-processing apparatus 200 with a paper sheet P as a sheet medium after image formation. The image forming apparatus 300 may be a copier or a printer, for example.

The image forming apparatus 300 of the present embodiment is an electrophotographic image forming apparatus including an image processing circuit, a photoconductor, an optical writing device, a developing device, a transfer device, and a fixing device.

In a case where the image forming apparatus 300 is a copier, the image processing circuit converts image data read by a scanner into printable image data, and outputs the converted image data to the optical writing device. Likewise, image data that is input from an external device such as a personal computer is converted into printable image data, and the converted image data is output to the optical writing device.

The optical writing device performs optical writing on the photoconductor in accordance with an image signal output from the image processing circuit, and forms an electrostatic latent image on the surface of the photoconductor. The developing device performs toner development on the electrostatic latent image that has been formed on the surface of the photoconductor by the optical writing. The transfer device transfers the toner image visualized on the surface of the photoconductor by the developing device onto a paper sheet P. The fixing device fixes the toner image which has been transferred on the paper sheet P, to the paper sheet P.

The paper sheet P to which the toner image is fixed is sent out from the image forming apparatus 300 to the post-processing apparatus 200, and desired post-processing is performed on the paper sheet P by the post-processing apparatus 200. The image forming apparatus 300 according to the present embodiment is of an electrophotographic system as described above, but an image forming apparatus of any known system such as an inkjet system or a thermal transfer system can be combined as the image forming apparatus 300 with the post-processing apparatus 200.

As illustrated in FIG. 1, the post-processing apparatus 200 is attached to a side of the image forming apparatus 300, and a paper sheet P ejected from the image forming apparatus 300 is guided to the post-processing apparatus 200.

The post-processing apparatus 200 according to the present embodiment can perform various processes such as punching (with a punch unit 100), side stapling (with a side stapler S1), saddle stitching (with a saddle stitching stapler S2), center folding (with a folding roller pair 14), and sorting of paper sheets P.

An inlet portion A of the post-processing apparatus 200 is the portion to which a paper sheet P ejected from the image forming apparatus 300 is first conveyed, and includes a single-sheet post-processing device that performs post-processing on each of the paper sheets P passing through the inlet portion A (in the present embodiment, the single-sheet post-process sing device is the punch unit 100 serving as a punching device).

A first ejection conveyance passage B that guides a paper sheet P to a shift tray 201 is formed above the inlet portion A, and a second ejection conveyance passage C that guides a paper sheet P to a shift tray 202 is formed on a side (to the left in FIG. 1) of the inlet portion A. Further, a stapling conveyance passage D that guides a paper sheet P to a stapling tray F that performs alignment, stapling, and the like is formed below the inlet portion A of the post-processing apparatus 200.

The inlet portion A is a conveyance passage on the upstream side in the conveyance direction with respect to the first ejection conveyance passage B, the second ejection conveyance passage C, and the stapling conveyance passage D, and forms a common conveyance passage for all the paper sheets P transferred from the image forming apparatus 300 to the post-processing apparatus 200. An entry sensor that detects passage of a paper sheet P received from the image forming apparatus 300 is disposed at the inlet portion A, and an inlet roller pair 1, the punch unit 100, and a pre-bifurcating conveyance roller pair 2 are arranged in this order on the downstream side of the entry sensor. Further, two bifurcating claws (a first bifurcating claw 15 and a second bifurcating claw 16) are arranged on the downstream side of the pre-bifurcating conveyance roller pair 2 of the inlet portion A.

The first bifurcating claw 15 and the second bifurcating claw 16 are each held in the state illustrated in FIG. 1 by a biasing member such as a spring. That is, the first bifurcating claw 15 is biased so that its tip faces downward, and the second bifurcating claw 16 is biased so that its tip faces upward. The first bifurcating claw 15 and the second bifurcating claw 16 are each coupled to a solenoid.

When each solenoid is turned on, the tips of the first bifurcating claw 15 and the second bifurcating claw 16 are displaced from the state illustrated in FIG. 1, and it becomes possible to switch the conveyance passages of the paper sheets P passing through the positions at which the respective bifurcating claws are disposed.

In the post-processing apparatus 200, the combination of the ON/OFF states of the respective solenoids of the first bifurcating claw 15 and the second bifurcating claw 16 is changed, so that the conveyance passage of a paper sheet P that has passed through the inlet portion A is switched to the first ejection conveyance passage B, the second ejection conveyance passage C, or the stapling conveyance passage D.

A shift tray sheet ejection unit, which includes shift trays 201 and 202 and the like, is disposed at the most downstream portion of the conveyance passage of a paper sheet P passing through the inlet portion A, the first ejection conveyance passage B, and the second ejection conveyance passage C in the post-processing apparatus 200. Further, the shift tray sheet ejection unit includes a tray shifter that reciprocates the shift trays 201 and 202 in a direction (the paper width direction) orthogonal to the direction of conveyance of the paper sheets P, and a tray lifter that moves up and down the shift trays 201 and 202 in the vertical direction.

In the stapling conveyance passage D, a stapling conveyance passage first roller pair 7, a sheet guide claw, a pre-stack sensor, a stapling conveyance passage second roller pair 9, a stapling conveyance passage third roller pair 10, and the like are arranged in this order from the upstream side in the conveyance direction.

Further, as illustrated in FIG. 1, the stapling conveyance passage D on the downstream side of the stapling conveyance passage third roller pair 10 is curved. A curve entrance sheet sensor is disposed at the entrance of the curve, and detects whether a paper sheet P has passed at the position at which the sheet sensor is disposed. Further, a forwarding roller pair 11 that transfers the paper sheet P that has passed through the stapling conveyance passage D to the stapling tray F is disposed at the exit of this curve.

In the post-processing apparatus 200, while stapling (an example of binding) is being performed on the stapling tray F, the stapling tray F is not able to receive the next paper sheet P. If the transfer of a paper sheet P from the image forming apparatus 300 to the post-processing apparatus 200 is suspended so that any new paper sheet P is not supplied to the stapling tray F while stapling is being performed on the stapling tray F, the productivity of the entire image forming system 600 drops.

Therefore, to secure sufficient time for stapling while maintaining the productivity of the entire image forming system 600, the post-processing apparatus 200 temporarily retains paper sheets P, and conveys a plurality of the paper sheets P simultaneously to the stapling tray F, to secure substantial time for stapling. This process is called a pre-stack process.

The paper sheets P guided to the stapling tray F through the inlet portion A and the stapling conveyance passage D are subjected to post-processing such as alignment and stapling on the stapling tray F. Further, the paper sheets P are sent into the conveyance passage leading to the shift tray 202 or into the conveyance passage leading to a sheet stack tray 401 of a saddle stitching stack tray portion Z by a sheet bundle sorting guide member 13.

When the paper sheets P are sent into the conveyance passage leading to the shift tray 202, the paper sheets P are guided to the vicinity of and upstream from a second ejected sheet sensor in the second ejection conveyance passage C, and are ejected onto the shift tray 202 by a second output roller pair 6, like paper sheets P passing through the second ejection conveyance passage C.

On the other hand, when the paper sheets P are sent into the conveyance passage leading to the sheet stack tray 401, the paper sheets P are transferred to a saddle-stitching and center-folding section G that performs center folding and the like on the paper sheets P, and the saddle-stitching and center-folding section G performs post-processing such as center folding. The paper sheets P that have been subjected to post-processing such as center folding pass through a post-center-folding conveyance passage H, and are conveyed to the sheet stack tray 401.

Figure 2C:
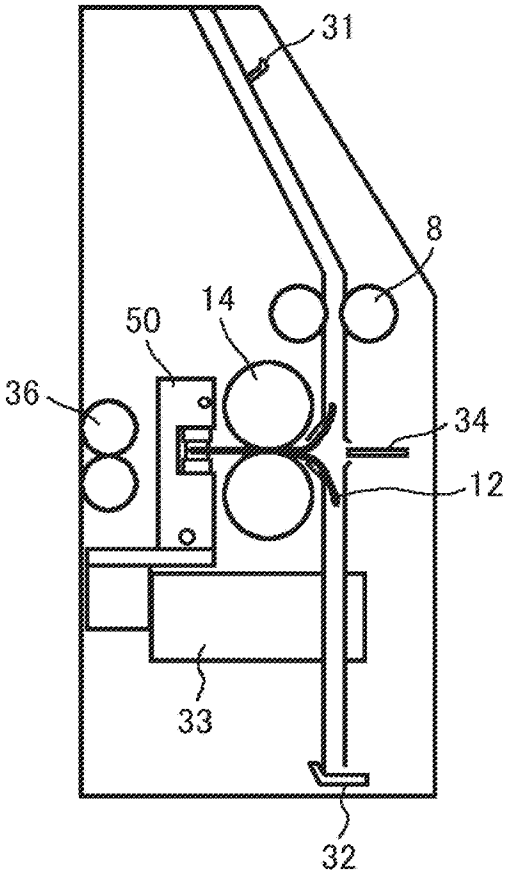
FIGS. 2A through 2C are diagrams schematically illustrating a configuration of a saddle-stitching and center-folding section according to an embodiment of the present disclosure.
Figure 2B:
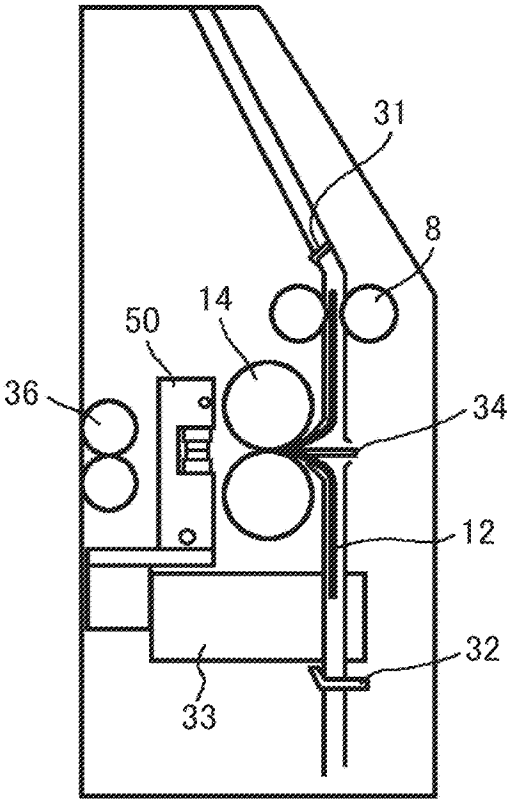
Figure 2A:
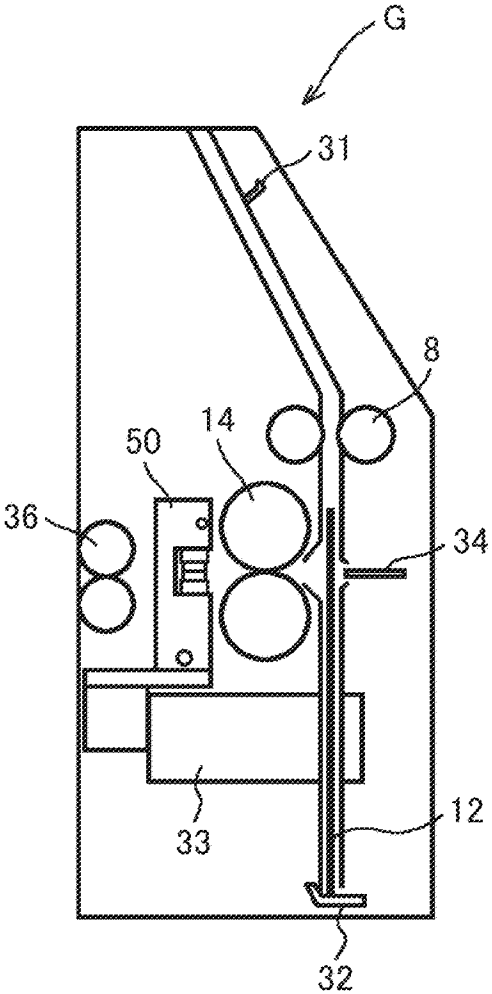

FIGS. 2A through 2C are diagrams schematically illustrating the configuration of the saddle-stitching and center-folding section according to an embodiment of the present disclosure. The saddle-stitching and center-folding section G includes: a conveyance roller pair 8 that conveys a sheet bundle 12 formed with a plurality of paper sheets P; an aligning claw 31 and a rear end fence 32 that are alignment members that align the sheet bundle 12; and a saddle stitching stapler 33 that staple the sheet bundle 12. The aligning claw 31 taps the rear end side of the sheet bundle 12 in the conveyance direction, and the front end side of the sheet bundle 12 in the conveyance direction is brought into contact with the rear end fence 32. Thus, the sheet bundle 12 is aligned.

The saddle-stitching and center-folding section G further includes a folding blade 34 that folds the saddle-stitched sheet bundle 12 in two at the center in the conveyance direction, and the folding roller pair 14 that conveys the sheet bundle 12 folded in two while pressing the sheet bundle 12 folded in two. A fold-enforcing device 50 that performs fold enforcing with a pair of pressing members along the fold line of the sheet bundle 12 folded in two is further provided.

As illustrated in FIG. 2A, the sheet bundle 12 transferred into the saddle-stitching and center-folding section G is conveyed by the conveyance roller pair 8. The sheet bundle 12 is then subjected to an aligning operation performed in the conveyance direction by the aligning claw 31 and the rear end fence 32, and thus, is aligned.

The aligned sheet bundle 12 is stapled by the saddle stitching stapler 33, and is lifted up to the folding position by the rear end fence 32. As illustrated in FIG. 2B, after the sheet bundle 12 reaches the folding position, a fold line is formed by the folding blade 34. The folding roller pair 14 pulls in the sheet bundle 12 having the fold line, and conveys the sheet bundle 12 to the pressing position of the fold-enforcing device 50 serving as a fold-enforcing member.

As illustrated in FIG. 2C, the fold-enforcing device 50 then presses the sheet bundle 12 in the width direction of the sheet bundle 12 along the fold line formed by the folding roller pair 14. After that, the pressed sheet bundle 12 is transferred to an output roller pair 36, and is conveyed to the sheet stack tray 401.

Figure 3:
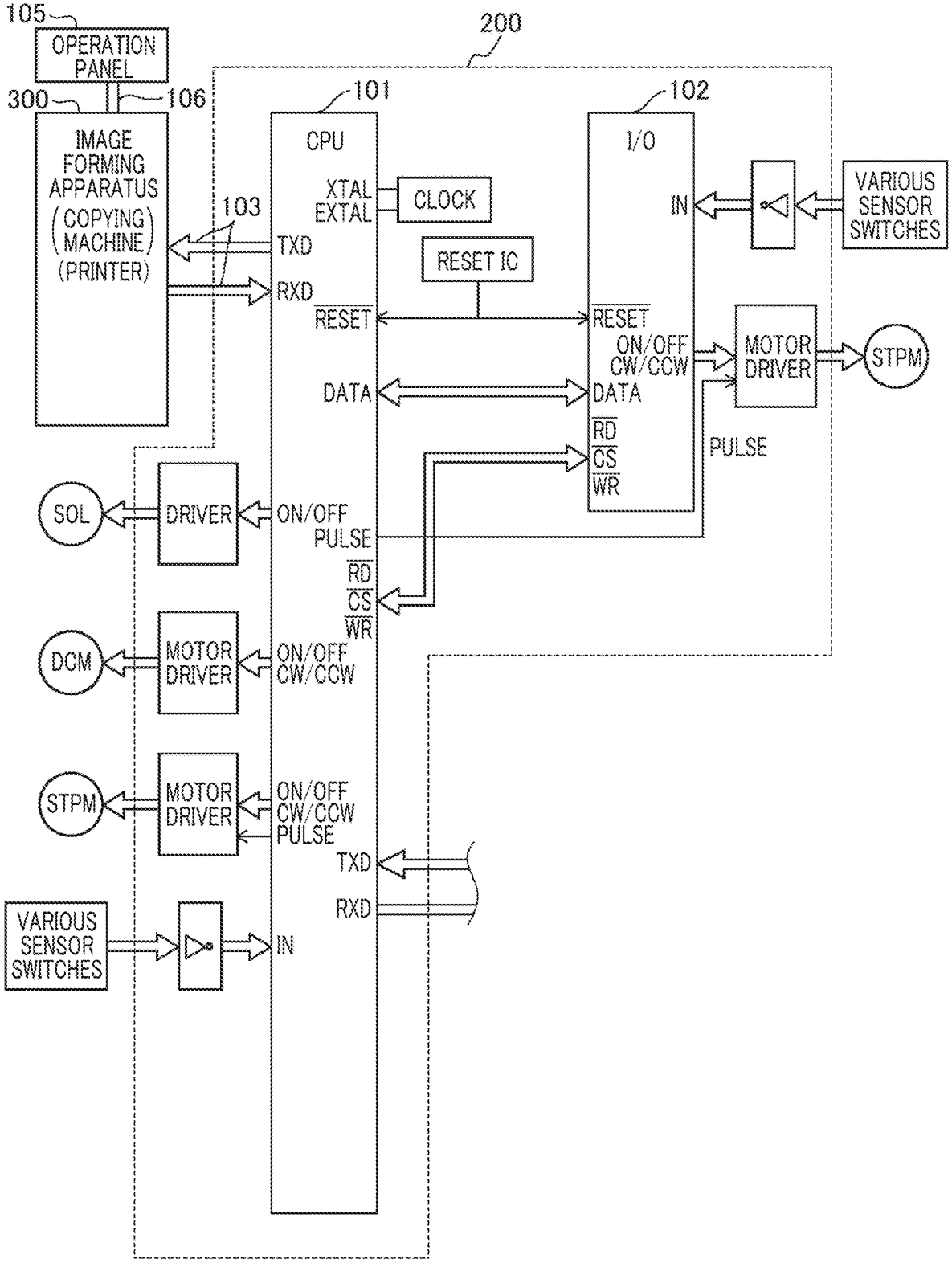
FIG. 3 is a block diagram illustrating an example of a control configuration of the image forming system illustrated in FIG. 1.

FIG. 3 is a block diagram illustrating an example of the control configuration in the image forming system illustrated in FIG. 1. The post-processing apparatus 200 includes control circuitry on which a microcomputer including a central processing unit (CPU) 101, an input/output (I/O) interface 102, and the like is mounted. A signal from the CPU of the image forming apparatus 300, signals from respective switches of a control panel 105, and signals from respective sensors are input to the CPU 101 via a communication interface 103, and the CPU 101 performs predetermined control in accordance with input signals. The control panel 105 is connected to the main body of the image forming apparatus 300 via a bus 106.

The CPU 101 controls the driving of each direct-current (DC) solenoid and each motor via a driver and a motor driver, and acquires information about each sensor in the apparatus from the I/O interface 102. Depending on the control target and the sensor information, the CPU 101 further controls the driving of the motors with a motor driver via the I/O interface 102, and acquires sensor information from the sensors.

As a result, the post-processing apparatus 200 (the fold-enforcing device 50) can acquire information such as the size and the number of the conveyed sheets.

Such control is performed according to a program defined by a program code stored in a read only memory (ROM), while the CPU 101 loads the program code into a random access memory (RAM), and uses this RAM as a work area and a data buffer.

Figure 4:
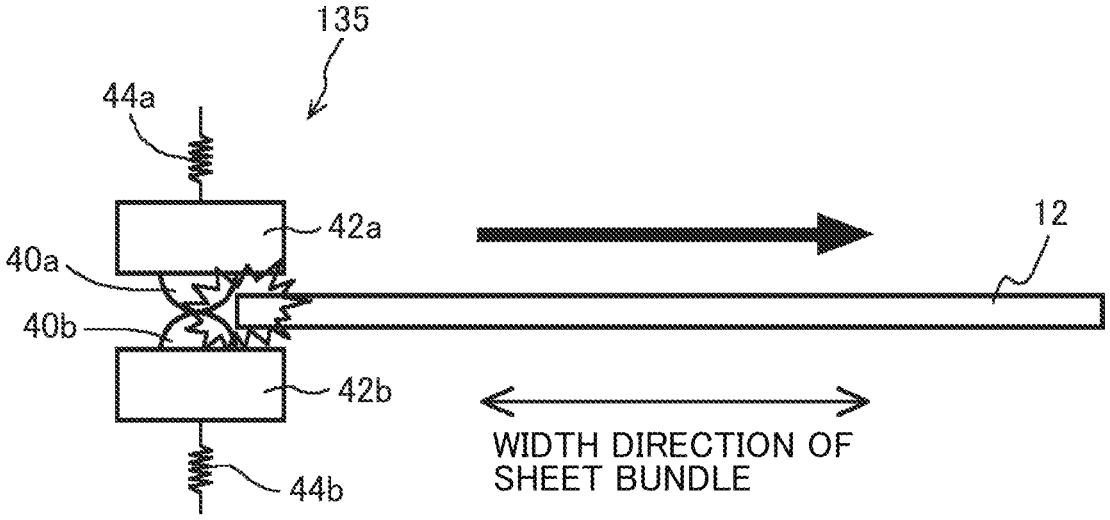
FIG. 4 is a schematic diagram illustrating a fold-enforcing operation to be performed by a comparative fold-enforcing device.
Figure 5A:
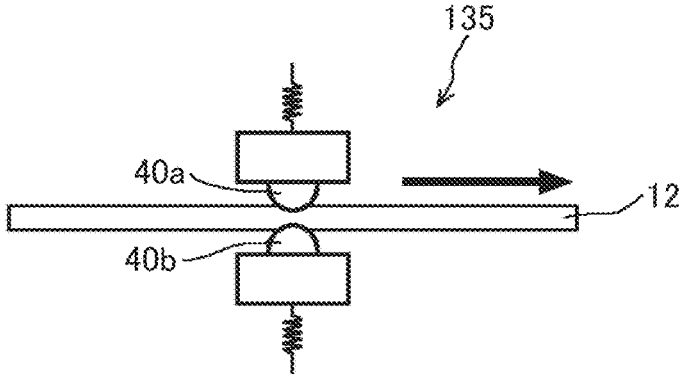
FIGS. 5A through 5E are schematic diagrams illustrating the fold-enforcing operation to be performed by the comparative fold-enforcing device.
Figure 5B:
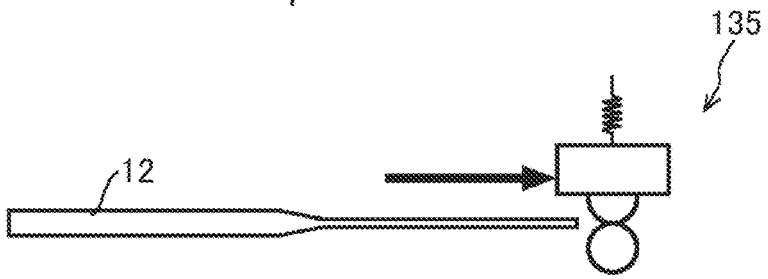
Figure 5C:
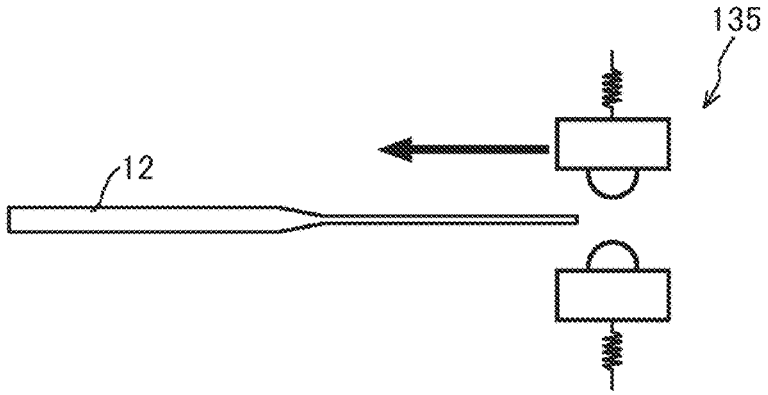
Figure 5D:
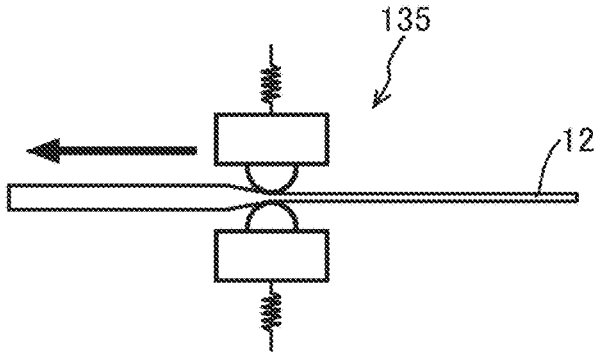
Figure 5E:
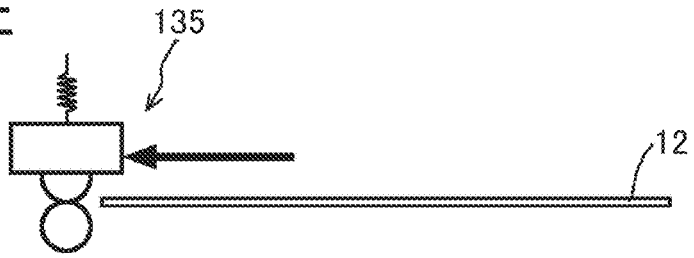

Next, the objective of the present disclosure is described in detail. FIGS. 4 and 5A through 5E are schematic diagrams illustrating a fold-enforcing operation to be performed by a comparative fold-enforcing device. As illustrated in FIG. 4, a comparative fold-enforcing device 135 includes a pair of pressing members 40*a* and 40*b*, a pair of housings 42*a* and 42*b*, and a pair of springs 44*a* and 44*b*.

In the fold-enforcing device 135, when the pressing members 40*a* and 40*b* start to nip an end of the sheet bundle 12 as illustrated in FIG. 4, the sheet bundle 12 pushes the pressing members 40*a* and 40*b* to open the nip and enters the nip between the pressing members 40*a* and 40*b*. Therefore, the end face of the sheet bundle 12 may be rubbed against the pressing members 40*a* and 40*b*, and damage such as a curl be caused at the end of the sheet bundle 12.

On the other hand, in the method illustrated in FIGS. 5A through 5E, in a state where the pressing members 40*a* and 40*b* are depressed, the fold-enforcing device 135 moves to the middle portion in the width direction of the sheet bundle 12, after which the fold-enforcing device 135 performs fold enforcing on the sheet bundle 12.

However, pressurizing or depressurizing of the pressing members 40*a* and 40*b* in accordance with the size of the sheet bundle 12 is not feasible. Therefore, to perform fold-enforcing on the entire sheet bundle 12, the fold-enforcing device 135 needs to reciprocate. As a result, productivity is reduced.

The following is a description of a fold-enforcing device that moves a fold-enforcing member, and pressurizes or depressurizes the sheet bundle, depending on the width-direction size of the sheet bundle.

Figure 6:
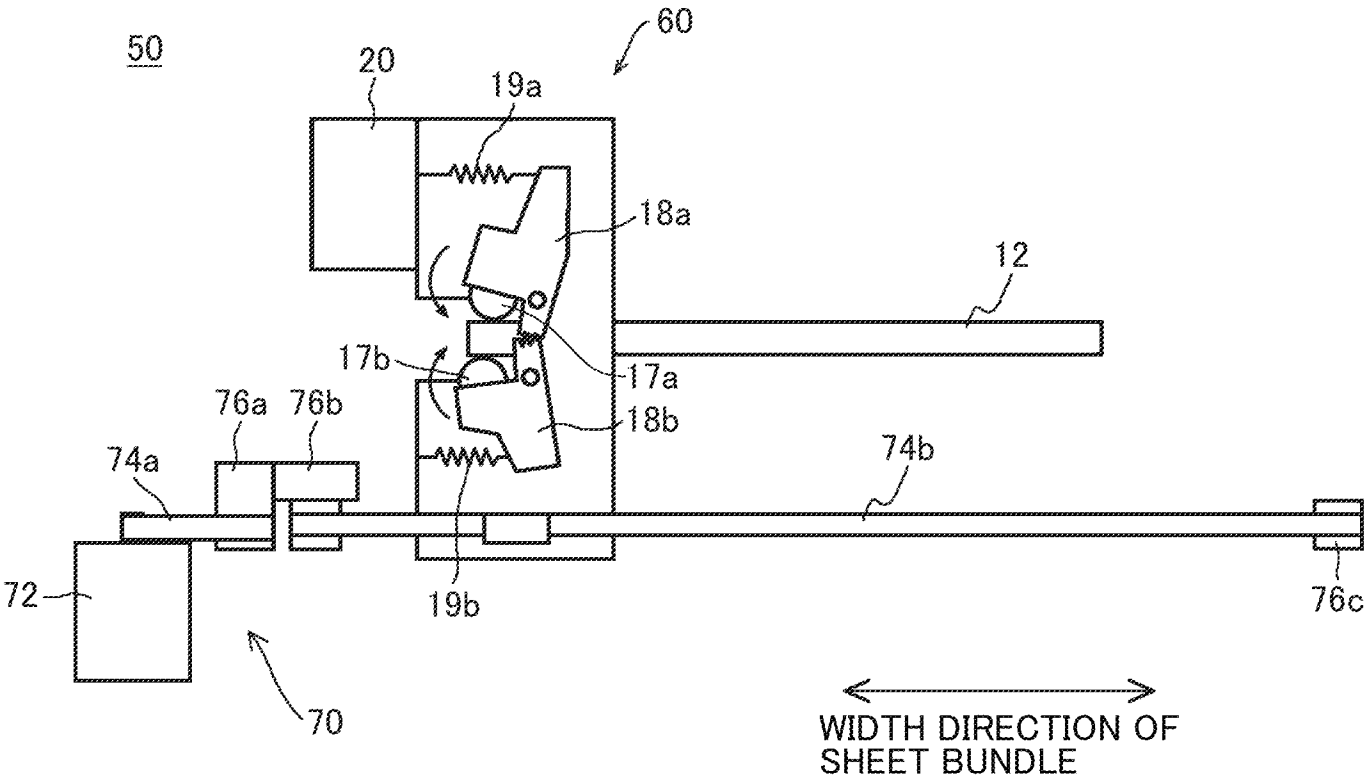
FIG. 6 is a side view illustrating a configuration of a fold-enforcing device according to an embodiment of the present disclosure.

FIG. 6 is a schematic view illustrating a configuration of a fold-enforcing device according to an embodiment of the present disclosure. As illustrated FIG. 6, the fold-enforcing device 50 includes a fold-enforcing unit 60, and a moving device 70. The fold-enforcing unit 60 is a fold-enforcing member that nips and presses the fold-line portion of the sheet bundle 12. The moving device 70 moves the fold-enforcing unit 60 in the fold-line direction (the width direction) of the sheet bundle 12.

The fold-enforcing unit 60 includes a pair of fold-enforcing rollers 17*a* and 17*b* that pressurize the fold line of the sheet bundle 12 in the thickness direction of the sheet bundle 12, a pressing mechanism that pressurizes and depressurizes the pressing members, and a pressurization and depressurization motor 20 serving as a driver that drives the pressing mechanism. The fold-enforcing rollers 17*a* and 17*b* are an example of the pressing members.

The moving device 70 includes a motor 72, pulleys 76*a*, 76*b*, and 76*c*, and belts 74*a* and 74*b*. The belt 74*b* is stretched between the pulley 76*b* and the pulley 76*c*, and is also coupled to the fold-enforcing unit 60. Accordingly, as the moving device 70 transmits the driving of the motor 72 to the pulley 76*b* via the belt 74*a* and the pulley 76*a*, the belt 74*b* can be driven so that the fold-enforcing unit 60 can be reciprocated in the sheet-width direction (the fold-line direction of the sheet bundle 12).

The motor 72 of the moving device 70 is formed with a pulse motor, for example, and pulse control can be performed.

Figure 7:
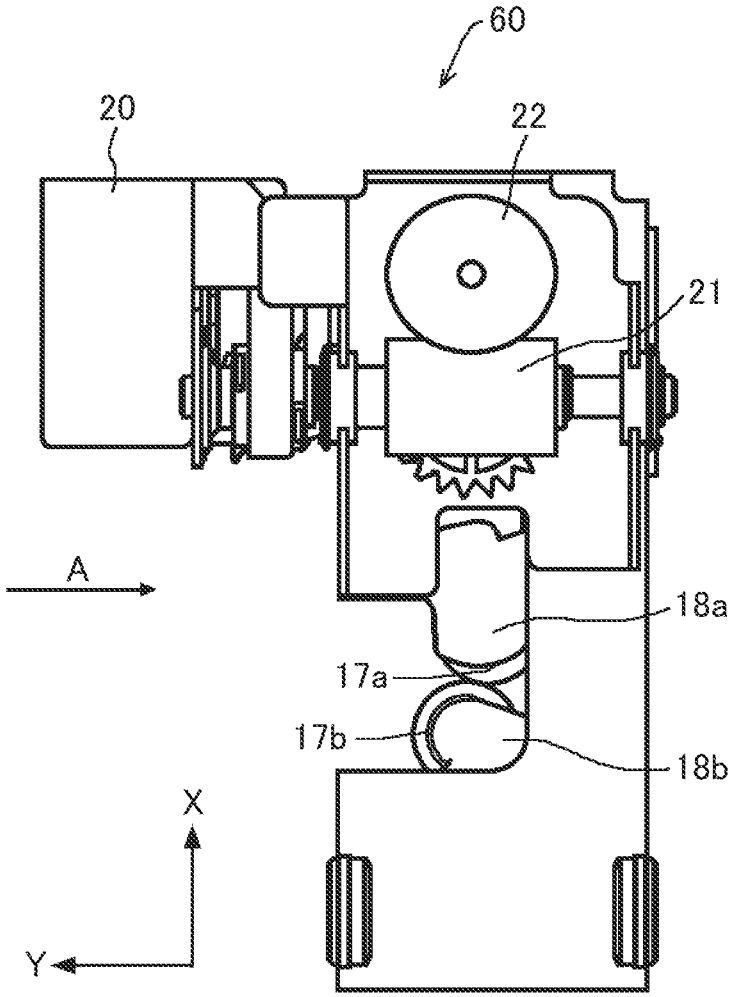
FIG. 7 is a front view illustrating a configuration of a fold-enforcing unit of the fold-enforcing device illustrated in FIG. 6.
Figure 8:
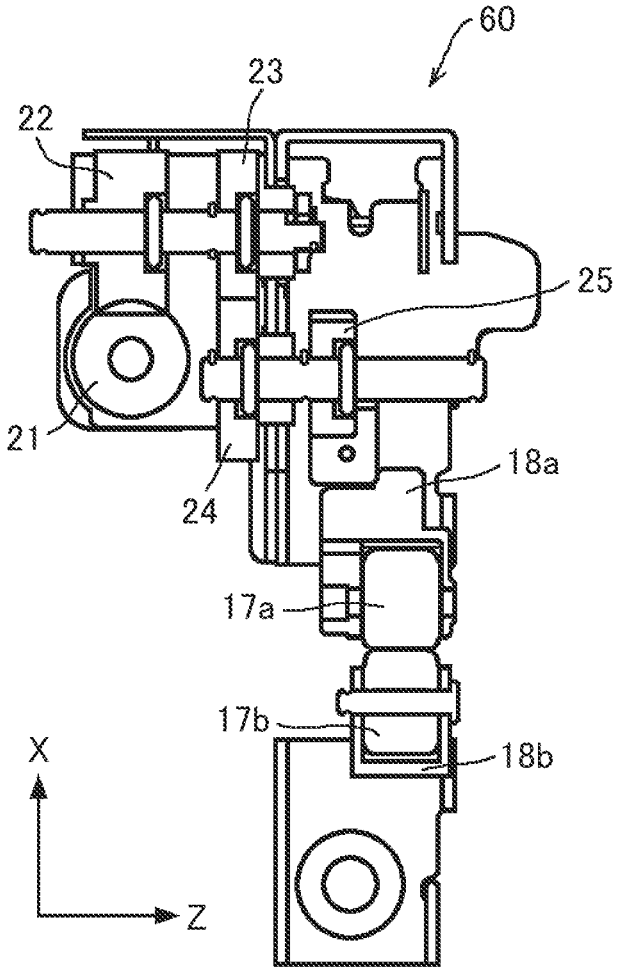
FIG. 8 is a side view illustrating the configuration of the fold-enforcing unit of FIG. 7 as viewed from the direction of an arrow A.

FIG. 7 is a diagram illustrating the configuration of a fold-enforcing unit according to an embodiment of the present disclosure as viewed from the front. FIG. 8 is a diagram illustrating the configuration of the fold-enforcing unit of FIG. 7 as viewed from the direction of an arrow A.

As illustrated in FIG. 7, the rotation of the pressurization and depressurization motor 20 is transmitted to a worm wheel 22 via a worm gear 21. As illustrated in FIG. 8, a first connection gear 23 is disposed on the same axis as the worm wheel 22, and a second connection gear 24 is engaged with the first connection gear 23. Further, a cam 25 is disposed on the same axis as the second connection gear 24. Accordingly, the cam 25 is rotated by the pressurization and depressurization motor 20.

The worm gear 21, the worm wheel 22, the first and second connection gears 23 and 24, the cam 25, first and second roller housings 18*a* and 18*b*, the first and second pressure springs 19*a* and 19*b*, and the like construct an example of the pressing mechanism that pressurizes or depressurizes the pressing members.

Figure 9:
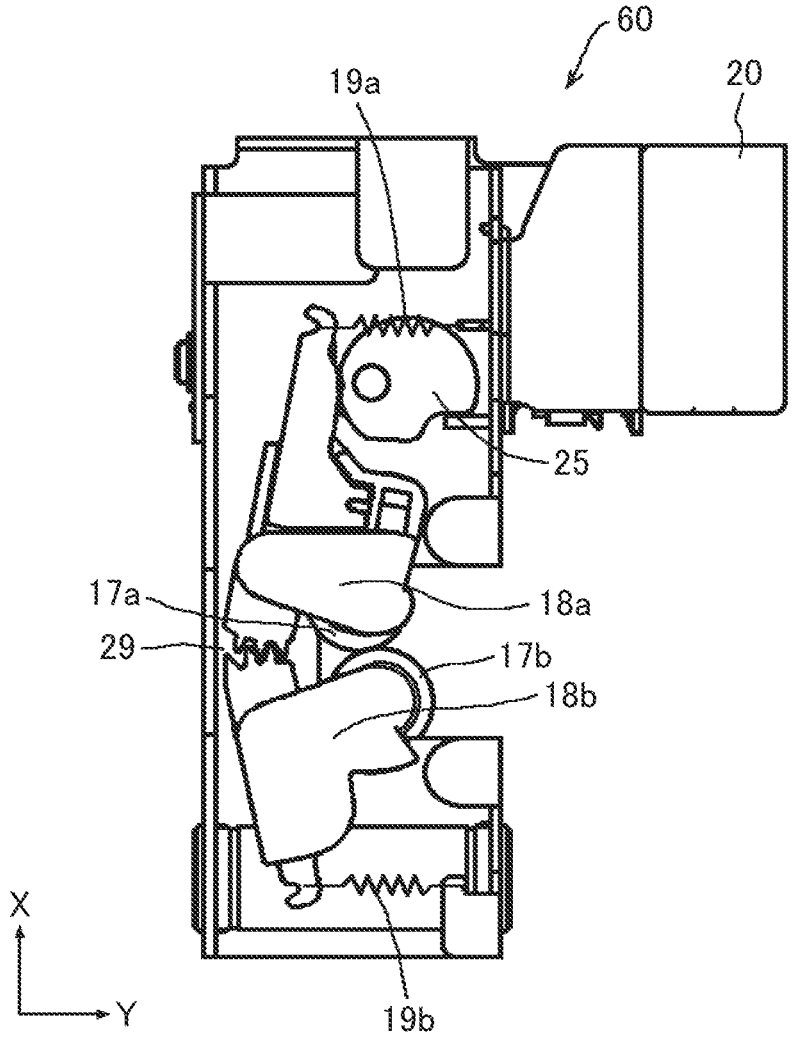
FIG. 9 is a side view illustrating the configuration of the fold-enforcing unit of FIG. 7 as viewed from the back.

FIG. 9 is a side view illustrating the configuration of the fold-enforcing unit of FIG. 7 as viewed from the back. As illustrated in FIG. 9, the cam 25 is an eccentric cam, and rotates while being in contact with the first roller housing 18*a*.

The first roller housing 18*a* is attached to the casing of the fold-enforcing unit 60 so as to be rotatable (pivotable) about a rotation shaft extending in the vertical direction (Z direction) in the drawing. On the opposite side in the downward direction (−X-axis direction), the second roller housing 18*b* is attached to the casing of the fold-enforcing unit 60 so as to be rotatable (pivotable) about the rotation shaft extending in the vertical direction (Z direction) in the drawing.

The first roller housing 18*a* and the second roller housing 18*b* are molded in one piece with synchronizing gears 29, respectively. As the synchronizing gears 29 engage with each other, the first roller housing 18*a* and the second roller housing 18*b* are synchronized with each other and rotate (oscillate) at the same angle.

The first roller housing 18*a* and the second roller housing 18*b* are also biased to the right (Y direction) by a first pressure spring 19*a* and a second pressure spring 19*b* provided in the casing of the fold-enforcing unit 60.

Further, the first and second roller housings 18*a* and 18*b* support the fold-enforcing rollers 17*a* and 17*b*, which are the pressing members, so as to be rotatable about the rotation shaft extending in the Z direction.

The fold-enforcing unit 60 designed as described above performs pressurizing or depressurizing as described below.

Depressurizing Operation

When the pressurization and depressurization motor 20 rotates the cam 25 (counterclockwise in the drawing), the first and second roller housings 18*a* and 18*b* rotate (the first roller housing 18*a* rotates counterclockwise while the second roller housing 18*b* rotates clockwise in the drawing) against the biasing force of the first and second pressure springs 19*a* and 19*b*. At this stage, the fold-enforcing rollers 17*a* and 17*b* are synchronized with each other and are separated (depressurized) at the same angle.

Pressuring Operation

When the pressurization and depressurization motor 20 rotates in the opposite direction from the above and the cam 25 rotates in the opposite direction, the first and second roller housings 18*a* and 18*b* rotate (the first roller housing 18*a* rotates clockwise while the second roller housing 18*b* rotates counterclockwise in the drawing) against the biasing force of the first and second pressure springs 19*a* and 19*b*. At this stage, the fold-enforcing rollers 17*a* and 17*b* are synchronized with each other, moved at the same angle, and brought into contact with each other (are pressurized).

In this manner, the pair of fold-enforcing rollers 17*a* and 17*b* can move evenly (by the same distance) to the center position of the nip in synchronized with each other, and pressurize or depressurize the sheet bundle 12. Accordingly, the sheet bundle 12 can be evenly pressurized from above and below, regardless of the thickness of the nipped sheet bundle 12.

Thus, the staple pierced in the sheet bundle 12 in the saddle stitching process is advantageously located at the center position with respect to the fold line.

The fold-enforcing rollers 17*a* and 17*b* are biased by the first and second pressure springs 19*a* and 19*b*, respectively, and pressurize the nipped sheet bundle 12. The pressing force exerted by the first and second pressure springs 19*a* and 19*b* increases as the thickness of the nipped sheet bundle 12 increases. Thus, the pressurizing force of the fold-enforcing rollers 17*a* and 17*b* changes with the thickness of the nipped sheet bundle 12. Accordingly, there is no risk of damaging the sheet bundle 12 even when the sheet bundle 12 is formed with a small number of sheets. In another embodiment, tension springs are used instead of pressure springs.

Next, a fold-enforcing operation of the fold-enforcing device 50 is described.

Figure 10:
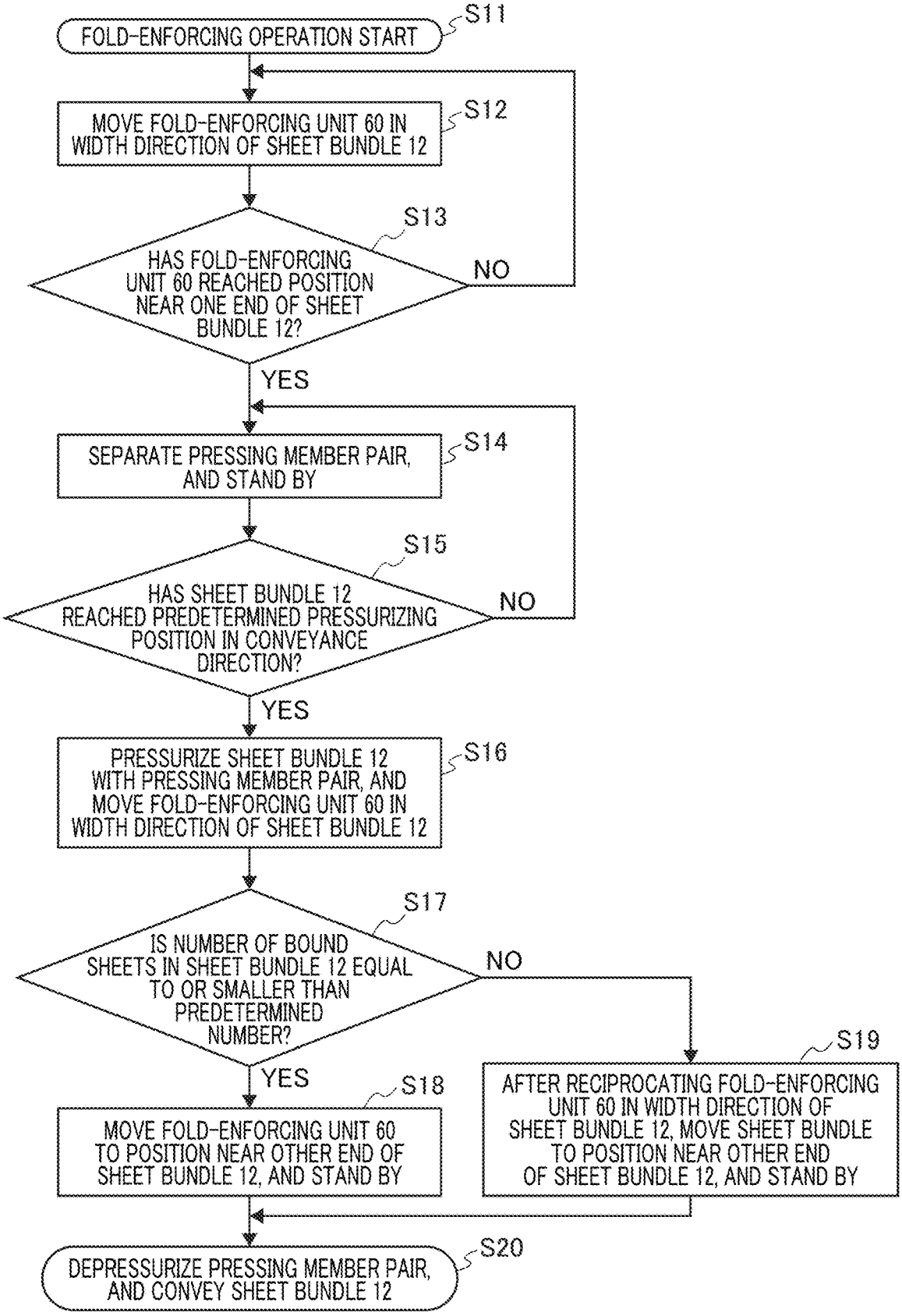
FIG. 10 is a flowchart illustrating a fold-enforcing operation of the fold-enforcing device according to the present embodiment.

FIG. 10 is a flowchart illustrating a fold-enforcing operation of the fold-enforcing device according to the present embodiment. FIGS. 11A through 11D are schematic diagrams illustrating states of the fold-enforcing device corresponding to the flowchart in FIG. 10. A fold-enforcing operation of the fold-enforcing device 50 configured as described above is now described, with reference to the flowchart in FIG. 10.

In step S11, the fold-enforcing device 50 that has received a fold-enforcing operation instruction starts a fold-enforcing operation. In step S12, the fold-enforcing device 50 drives the motor 72, to move the fold-enforcing unit 60 toward the vicinity of one end of the sheet bundle 12 in the width direction of the sheet bundle 12.

In step S13, the fold-enforcing device 50 determines, with the CPU 101, whether the fold-enforcing unit 60 has arrived at a predetermined standby position (near the one end of the sheet bundle 12). When the fold-enforcing unit 60 has not arrived at the predetermined standby position (in the case of NO), the fold-enforcing device 50 continues to move the fold-enforcing unit 60. The predetermined standby position is a position inside the end of the sheet bundle in the width direction and corresponds to the sheet width detected by a sheet size sensor. For example, the CPU 101 acquires setting made by a manufacturer.

When the fold-enforcing unit 60 has arrived at the predetermined standby position (in the case of YES), the process proceeds to step S14. In step S14, the fold-enforcing device 50 drives the pressurization and depressurization motor 20 to synchronously move the fold-enforcing rollers 17*a* and 17*b* (pressing member pair) an equal distance to be separated from each other. Then, the fold-enforcing device 50 sets the fold-enforcing rollers 17*a* and 17*b* standby.

In step S15, the fold-enforcing device 50 determines, with the CPU 101, whether the sheet bundle 12 has reached a predetermined pressing position in the conveyance direction. If the sheet bundle 12 has not arrived at the predetermined pressing position (in the case of NO), the fold-enforcing device 50 continues to stand by.

If the sheet bundle 12 has arrived at the predetermined pressing position (in the case of YES), on the other hand, the fold-enforcing device 50 moves on to step S16. In step S16, the fold-enforcing device 50 drives the pressurization and depressurization motor 20, so that the fold-enforcing rollers 17*a* and 17*b* pressurize the sheet bundle 12 evenly in the thickness direction (see FIG. 11A).

Figure 11A:
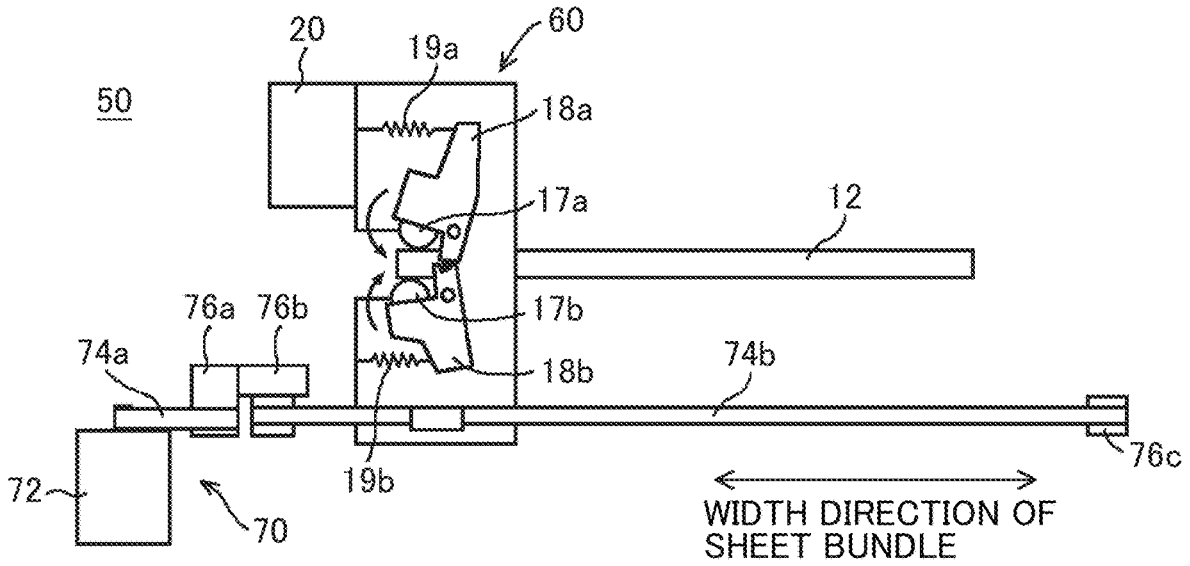
FIGS. 11A through 11D are schematic views illustrating states of the fold-enforcing device corresponding to the flowchart illustrated in FIG. 10.
Figure 11B:
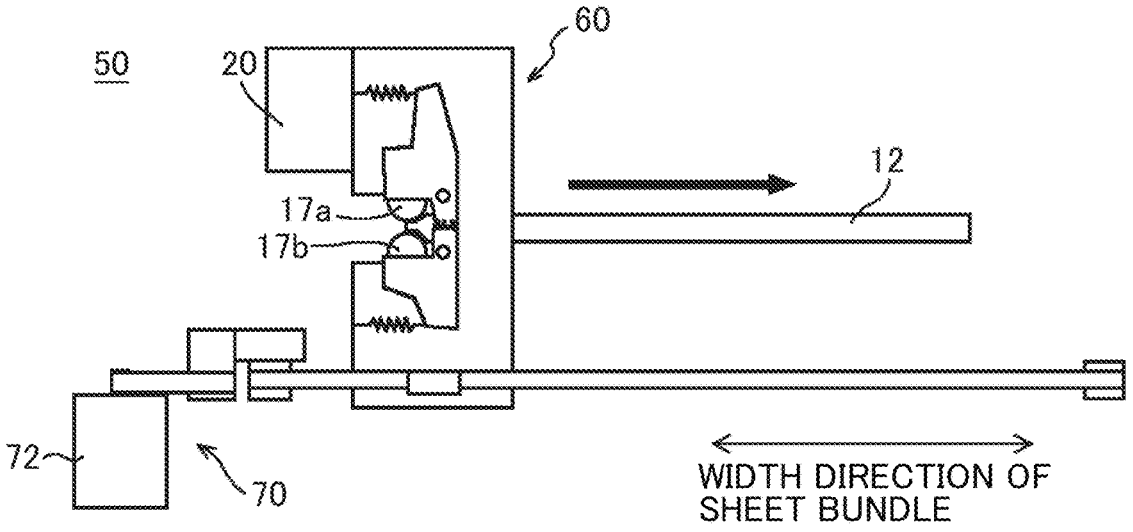
Figure 11C:
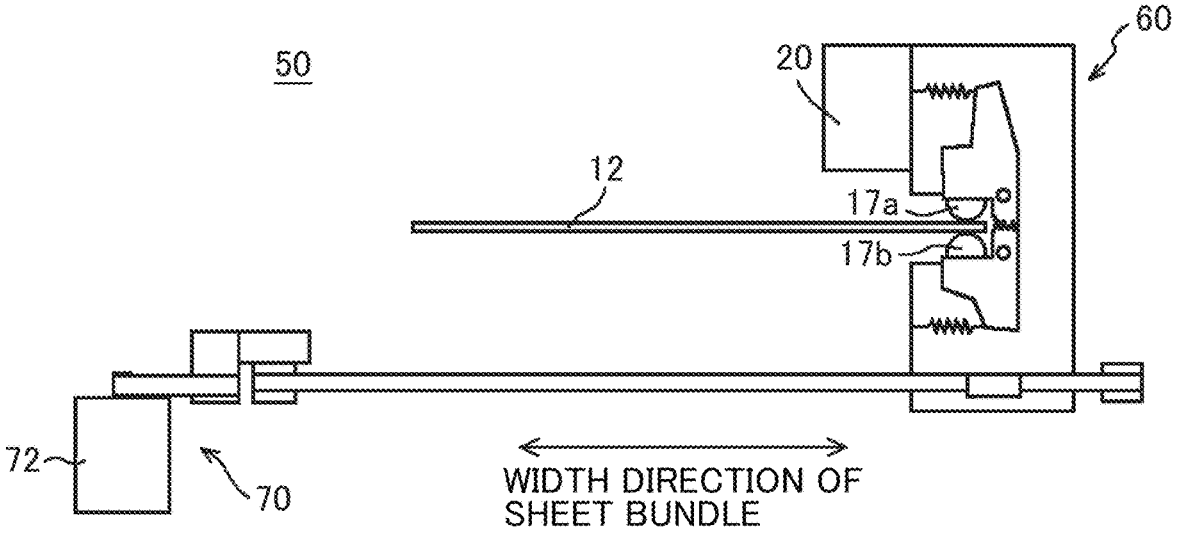
Figure 11D:
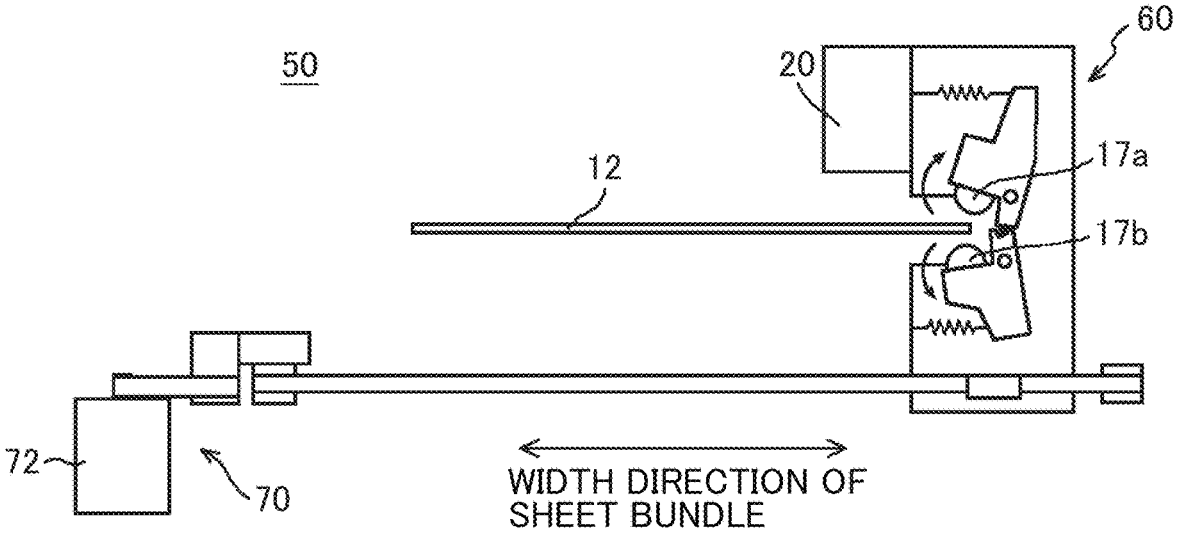

The fold-enforcing device 50 then drives the motor 72, to move the fold-enforcing unit 60 in the width direction of the sheet bundle 12 toward the other end of the sheet bundle 12 (execution of fold-enforcing; see FIG. 11B).

In step S17, the fold-enforcing device 50 determines, with the CPU 101, whether the number of bound sheets in the sheet bundle 12 is equal to or smaller than a predetermined number. If the number of bound sheets is equal to or smaller than the predetermined number (in the case of YES), the fold-enforcing device 50 moves on to step S18, and moves the fold-enforcing unit 60 in the width direction of the sheet bundle 12 toward a position near the other end of the sheet bundle 12 before a stop (see FIG. 11C).

The fold-enforcing device 50 then moves on to step S20. In step S20, the fold-enforcing device 50 depressurizes the fold-enforcing rollers 17*a* and 17*b* and ends the fold-enforcing operation (see FIG. 11D). The fold-enforcing device 50 depressurizes the fold-enforcing rollers 17*a* and 17*b* positioned in an end portion of the sheet bundle 12, that is, inside the end in the width direction of the sheet bundle 12. The sheet bundle 12 is then conveyed in the conveyance direction.

If the number of bound sheets is larger than the predetermined number (in the case of NO), the fold-enforcing device 50 moves on to step S19. In step S19, the fold-enforcing device 50 reciprocates the fold-enforcing unit 60 in the width direction of the sheet bundle 12, and again moves the fold-enforcing unit 60 to a position near the other end of the sheet bundle 12 before a stop (see FIG. 11C).

The fold-enforcing device 50 then moves on to step S20. In step S20, the fold-enforcing device 50 depressurizes the fold-enforcing rollers 17*a* and 17*b*, and the fold-enforcing operation comes to an end (see FIG. 11D). The sheet bundle 12 is then conveyed in the conveyance direction.

As described above, the fold-enforcing device 50 of the present embodiment moves the fold-enforcing unit 60 in accordance with the size of the sheet bundle 12 in the width direction (the fold-line direction), and pressurizes the sheet bundle 12 near one end of the sheet bundle 12. For example, the fold-enforcing device 50 acquires the size of the sheet bundle 12 in the width direction from the control circuit of the main body. Alternatively, the fold-enforcing device 50 can include a sheet width sensor disposed in the vicinity of the fold-enforcing members, to detect an end of the sheet bundle 12 in the width direction.

Further, while pressurizing the sheet bundle 12, the fold-enforcing device 50 moves the fold-enforcing unit 60 in the width direction of the sheet bundle 12, and depressurizes the sheet bundle 12 near the other end of the sheet bundle 12.

Accordingly, the sheet bundle 12 can be pressurized or depressurized without being damaging at an end portion. Further, there is no need to reciprocate the fold-enforcing unit 60, and thus, a decrease in productivity can be prevented.

As illustrated in steps S17 through S19, the fold-enforcing device 50 of the present embodiment moves the fold-enforcing unit 60 while pressurizing the sheet bundle 12, and, preferably, the number of times the fold-enforcing unit 60 moves is changed in accordance with the number of sheets in the sheet bundle 12. For example, in a case where there is a waiting time for a sheet coming from the image forming apparatus 300, fold enforcing is performed a plurality of times, to reduce the height of the fold of the sheet bundle 12 without any decrease in productivity.

Next, other advantageous configurations of the present disclosure are described.

As described above with reference to FIG. 6, the pair of fold-enforcing rollers 17*a* and 17*b* pressurizes or depressurizes the sheet bundle 12 at the nip portion. Here, the pair of fold-enforcing rollers 17*a* and 17*b* pressurizes the sheet bundle 12 in a state in which the line connecting the respective centers of the fold-enforcing rollers 17*a* and 17*b* is not parallel (that is, intersecting with) the thickness direction of the sheet bundle 12. The nip positions of the fold-enforcing rollers 17*a* and 17*b* is shifted, so that the sheet bundle 12 can be pressurized while being squeezed, and the height the fold of the sheet bundle 12 can be further reduced.

In step S15 of the flowchart in FIG. 10 described above, the fold-enforcing device 50 (the CPU 101) determines whether the sheet bundle 12 has reached the predetermined pressing position in the conveyance direction. Here, the fold-enforcing device 50 is preferably capable of adjusting the pressing position of the sheet bundle 12 in the direction of conveyance of the sheet bundle 12.

Figure 12:
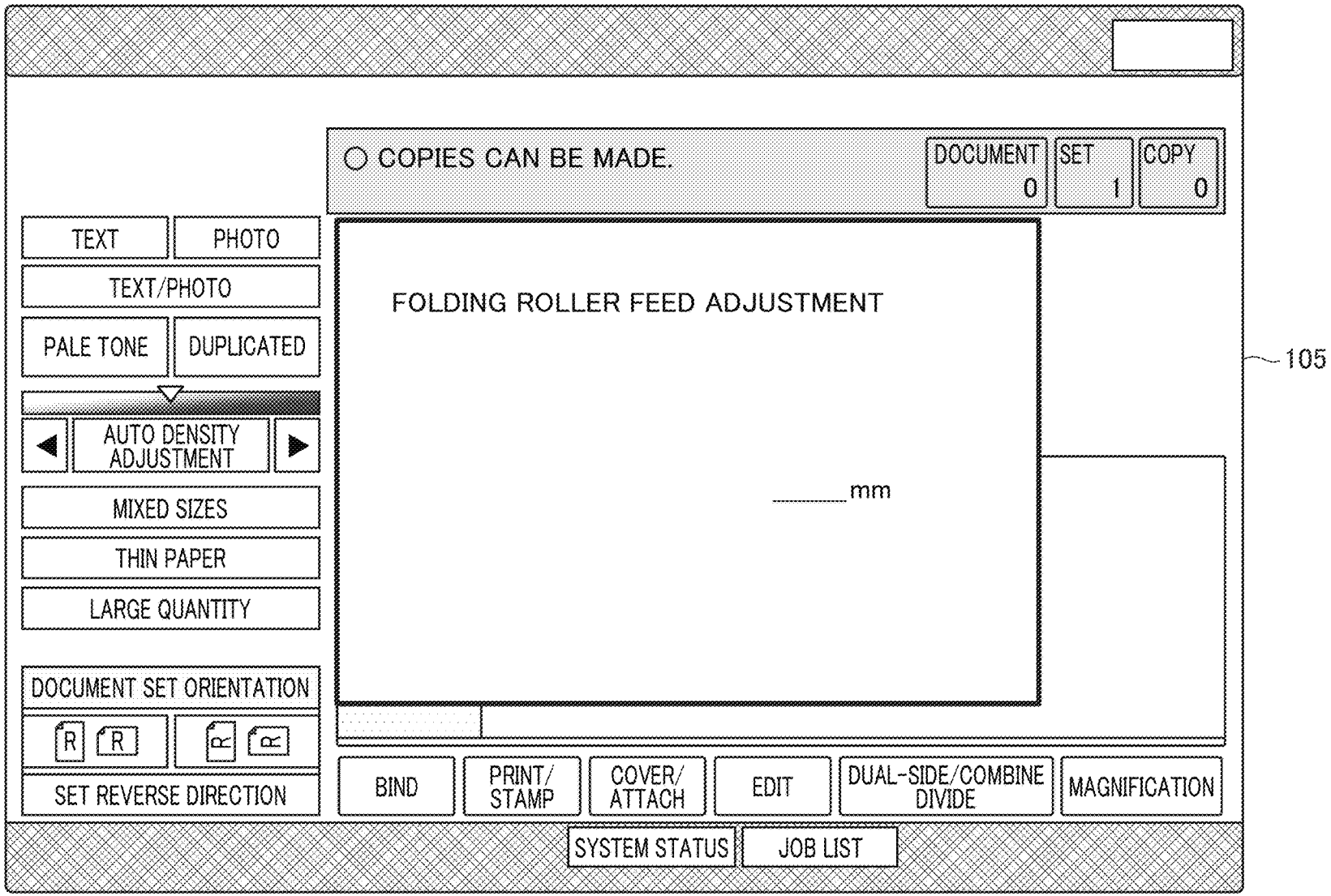
FIG. 12 is a diagram illustrating input of folding roller feed adjustment through a control panel.

Further, as illustrated in FIG. 12, for example, the user may be allowed to set "folding roller feed adjustment" on the screen of the control panel 105. In accordance with the set feed amount, the fold-enforcing device 50 performs predetermined control, so that the pressing position of the sheet bundle 12 in the conveyance direction can be adjusted.

In a case where a sheet slips due to a sheet error and fold-enforcing is not performed at the target position in the conveyance direction, the pressing position is adjusted by the above setting. Thus, desired fold enforcing can be performed.

Figure 13A:
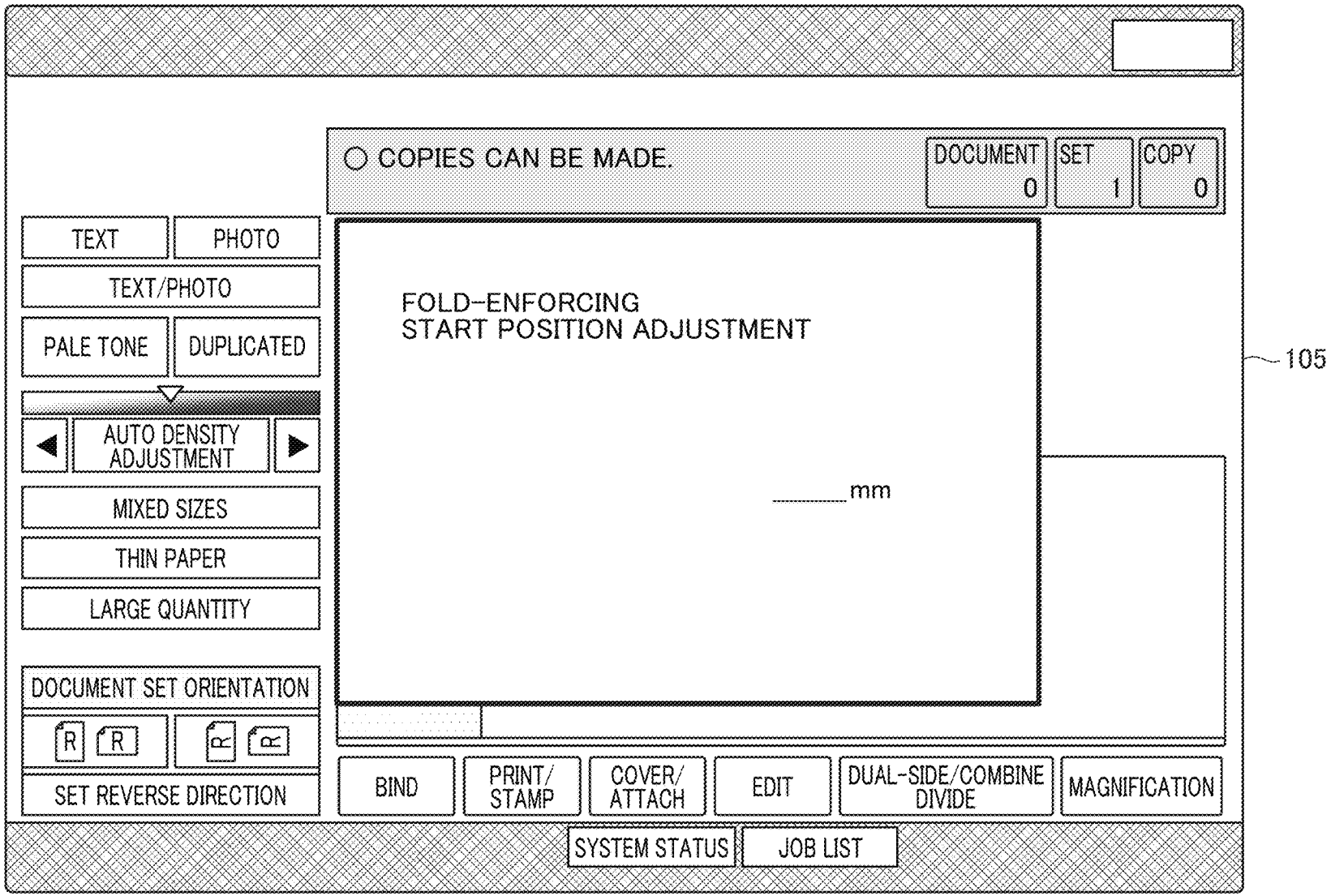
FIGS. 13A and 13B are diagrams illustrating input of fold-enforcing start (or stop) position adjustment through the control panel.
Figure 13B:
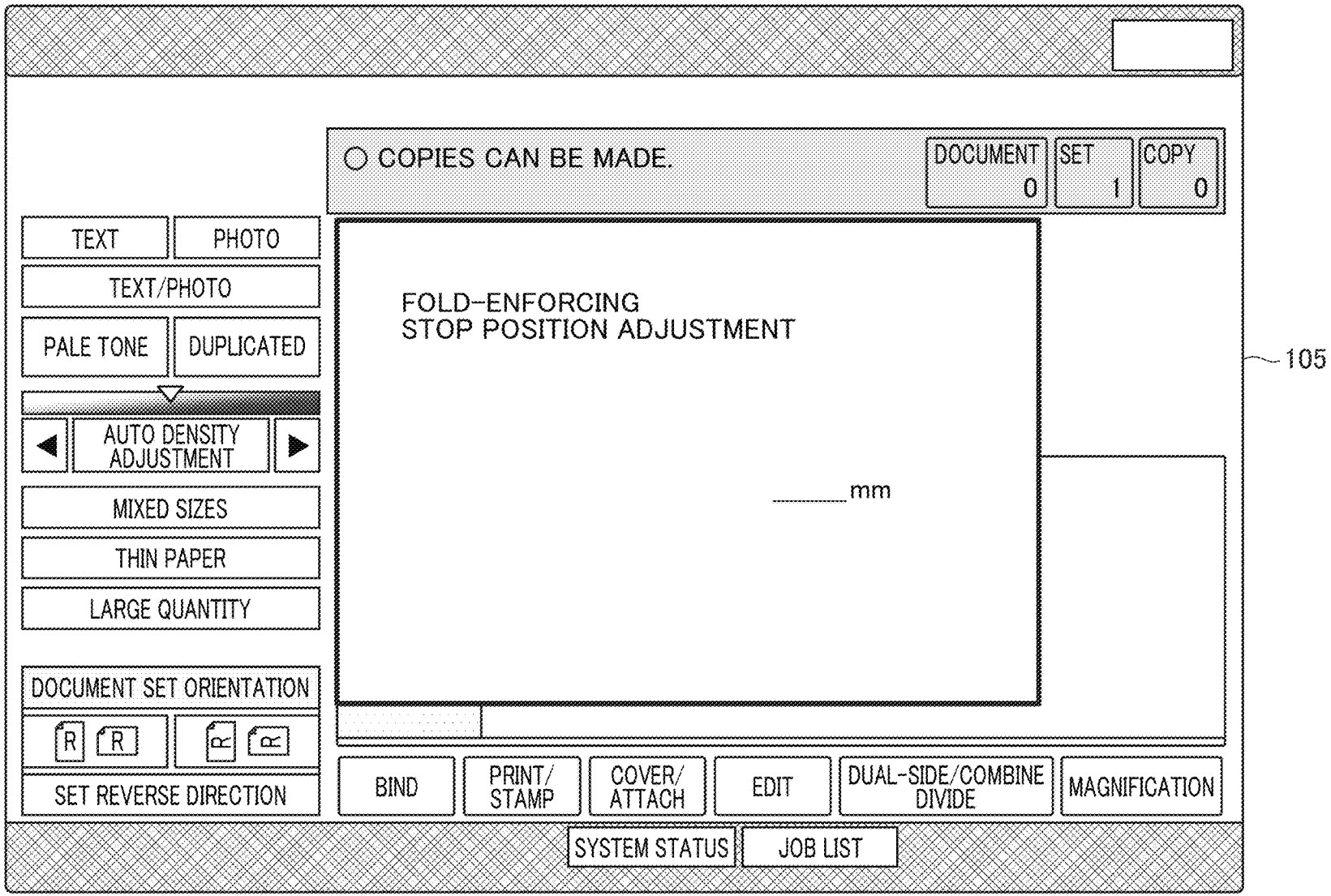

Further, the fold-enforcing device 50 is preferably capable of adjusting the pressing position from an end of the sheet bundle 12 in the width direction (the fold-line direction) of the sheet bundle 12. As illustrated in FIGS. 13A and 13B, for example, the user is allowed to perform at least one of "fold-enforcing start position adjustment" and "fold-enforcing stop position adjustment" on the screen of the control panel 105. In accordance with the set position data, the fold-enforcing device 50 performs predetermined control, thereby adjusting the pressing position from the end of the sheet bundle 12.

Thus, the height of the fold at either end of the sheet bundle 12 can be finely adjusted, which is advantageous.

The present disclosure has been described in detail so far, by way of an embodiment. This embodiment is an example, and can be modified in various manners without departing from the scope of the disclosure. The image forming apparatus is not necessarily a copier or a printer, but may be a facsimile machine or a multifunction peripheral having a plurality of functions.

Further, the image forming apparatus 300 according to the present embodiment is of an electrophotographic system, but an image forming apparatus of any known system such as an inkjet system or a thermal transfer system can be combined as the image forming apparatus 300 with the post-processing apparatus 200.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A fold-enforcing assembly comprising:

a fold-enforcing device including:

a pair of pressing members configured to nip and press a fold of a sheet bundle in a direction of thickness of the sheet bundle;

a pressing mechanism configured to pressurize and depressurize the pair of pressing members in the direction of thickness; and a driver configured to drive the pressing mechanism;

a moving device configured to move the fold-enforcing device in a direction of the fold; and control circuitry configured to:

move, with the moving device, the fold-enforcing device in accordance with a size of the sheet bundle in the direction of the fold;

adjust a pressing position in a direction of conveyance of the sheet bundle, the pressing position at which the pair of pressing members presses the sheet bundle;

pressurize, with the pressing mechanism, the pair of pressing members in the direction of thickness to press a first end portion of the sheet bundle in the direction of the fold;

move, with the moving device, the fold-enforcing device to a second end portion of the sheet bundle opposite the first end portion in the direction of the fold; and depressurize, with the pressing mechanism, the pair of pressing members in the second end portion.

2. The fold-enforcing assembly according to claim 1, wherein the pair of pressing members is configured to press the sheet bundle in a state where a line connecting respective centers of the pressing members is not parallel to the direction of thickness of the sheet bundle.

3. The fold-enforcing assembly according to claim 1, wherein the control circuitry is configured to cause the pressing mechanism to pressurize and depressurize the pair of pressing members inside an end of the sheet bundle in the direction of the fold.

4. The fold-enforcing assembly according to claim 1, wherein the pressing members are coupled to each other and configured to move toward a center in a nip between the pressing members by an equal distance in synchronized with each other.

5. The fold-enforcing assembly according to claim 1, wherein the pressing mechanism includes a pair of springs coupled to the pair of pressing members, respectively, and is configured to change a strength of pressing force of the pair of pressing members in accordance with a thickness of the sheet bundle.

6. The fold-enforcing assembly according to claim 1, wherein the control circuitry is configured to change a number of times the fold-enforcing device moves in the direction of the fold with the sheet bundle pressed by the pair of pressing members, in accordance with a number of sheets in the sheet bundle.

7. A fold-enforcing assembly comprising:

a fold-enforcing device including:

a pair of pressing members configured to nip and press a fold of a sheet bundle in a direction of thickness of the sheet bundle;

a pressing mechanism configured to pressurize and depressurize the pair of pressing members in the direction of thickness; and a driver configured to drive the pressing mechanism;

a moving device configured to move the fold-enforcing device in a direction of the fold; and control circuitry configured to:

move, with the moving device, the fold-enforcing device in accordance with a size of the sheet bundle in the direction of the fold;

adjust a pressing position from an end of the sheet bundle in the direction of the fold, the pressing position at which the pair of pressing members presses the sheet bundle;

pressurize, with the pressing mechanism, the pair of pressing members in the direction of thickness to press a first end portion of the sheet bundle in the direction of the fold;

move, with the moving device, the fold-enforcing device to a second end portion of the sheet bundle opposite the first end portion in the direction of the fold; and depressurize, with the pressing mechanism, the pair of pressing members in the second end portion.

8. A post-processing apparatus comprising:

a post-processing device configured to receive a sheet and perform post-processing on the sheet; and the fold-enforcing assembly according to claim 1, to nip and press a fold of the sheet.

9. An image forming system comprising:

an image forming apparatus configured to form an image on a sheet; and the post-processing apparatus according to claim 8, to perform post-processing on the sheet.

10. The fold-enforcing assembly according to claim 7, wherein the pair of pressing members is configured to press the sheet bundle in a state where a line connecting respective centers of the pressing members is not parallel to the direction of thickness of the sheet bundle.

11. The fold-enforcing assembly according to claim 7, wherein the control circuitry is configured to cause the pressing mechanism to pressurize and depressurize the pair of pressing members inside an end of the sheet bundle in the direction of the fold.

12. The fold-enforcing assembly according to claim 7, wherein the pressing members are coupled to each other and configured to move toward a center in a nip between the pressing members by an equal distance in synchronized with each other.

13. The fold-enforcing assembly according to claim 7, wherein the pressing mechanism includes a pair of springs coupled to the pair of pressing members, respectively, and is configured to change a strength of pressing force of the pair of pressing members in accordance with a thickness of the sheet bundle.

14. The fold-enforcing assembly according to claim 7, wherein the control circuitry is configured to change a number of times the fold-enforcing device moves in the direction of the fold with the sheet bundle pressed by the pair of pressing members, in accordance with a number of sheets in the sheet bundle.

15. A post-processing apparatus comprising:

a post-processing device configured to receive a sheet and perform post-processing on the sheet; and the fold-enforcing assembly according to claim 7, to nip and press a fold of the sheet.

16. An image forming system comprising:

an image forming apparatus configured to form an image on a sheet; and the post-processing apparatus according to claim 15, to perform post-processing on the sheet.

17. A controller configured to control a moving device to move a fold-enforcing device, the fold-enforcing device including a pair of pressing members configured to nip and press a fold of a sheet bundle in a direction of thickness of the sheet bundle, a pressing mechanism configured to pressurize and depressurize the pair of pressing members in the direction of thickness, and a driver configured to drive the pressing mechanism, the controller comprising:

control circuitry configured to, move, with the moving device, the fold-enforcing device in accordance with a size of the sheet bundle in the direction of the fold, adjust a pressing position in a direction of conveyance of the sheet bundle, the pressing position at which the pair of pressing members presses the sheet bundle, pressurize, with the pressing mechanism, the pair of pressing members in the direction of thickness to press a first end portion of the sheet bundle in the direction of the fold, move, with the moving device, the fold-enforcing device to a second end portion of the sheet bundle opposite the first end portion in the direction of the fold, and depressurize, with the pressing mechanism, the pair of pressing members in the second end portion.

* * * * *